US006948270B2

(12) United States Patent
Varasteh

(10) Patent No.: US 6,948,270 B2
(45) Date of Patent: Sep. 27, 2005

(54) MONOLITHIC DOUBLE-SIDED DISPLAY

(76) Inventor: Vahdat Varasteh, 784 Opal St., San Diego, CA (US) 92109

( * ) Notice: Subject to any disclaimer, the term of this patent is extended or adjusted under 35 U.S.C. 154(b) by 131 days.

(21) Appl. No.: 10/439,404

(22) Filed: May 16, 2003

(65) Prior Publication Data

US 2004/0040191 A1 Mar. 4, 2004

Related U.S. Application Data

(60) Provisional application No. 60/388,548, filed on Jun. 12, 2002.

(51) Int. Cl.[7] ..... G09F 15/00

(52) U.S. Cl. ..... 40/606.18; 40/611.01; 40/611.12; 40/618; 40/607.14

(58) Field of Search ..... 40/606.18, 611.01, 40/611.06, 611.12, 618, 607.14

(56) References Cited

U.S. PATENT DOCUMENTS 1,804,770 A * 5/1931 Hershfield ..... 40/611.01
2,048,359 A * 7/1936 Snell ..... 40/606.18
2,082,434 A 10/1937 White
2,333,302 A 5/1943 Enk
4,323,251 A 4/1982 Loveland et al.
4,864,757 A * 9/1989 Lovett ..... 40/611.12
5,031,782 A * 7/1991 Minervini ..... 40/375
5,390,889 A * 2/1995 Hiscock ..... 40/757
5,735,069 A * 4/1998 Gearing ..... 40/611.12
6,009,652 A * 1/2000 Smith ..... 40/611.12

* cited by examiner

*Primary Examiner*—Gary C. Hoge
(74) *Attorney, Agent, or Firm*—F. Jason Far-hadian, Esq.; Century IP Law Group

(57) ABSTRACT

A display apparatus for securing a display item for display is provided. The display apparatus comprises a monolithic frame made of a flexible light weight material having a body formed around the periphery of a central opening within which one or more display items can be mounted; and one or more fastening mechanisms extended from the inner perimeters of the frame body inward toward center of the central opening for slidably receiving the one or more display items. Each of the fastening mechanisms comprises first and second flexible loop tongues each having inner and outer surfaces, the inner surfaces of the first and second loop tongues facing each other and approximately coplanar to provide a receiving space therebetween, such that one or more edges of at least one display item can be frictionally secured in between said receiving space by wedging open the coplanar inner surfaces of the flexible loop tongues apart for a relatively tight fit therebetween.

11 Claims, 5 Drawing Sheets

MONOLITHIC DOUBLE-SIDED DISPLAY

CROSS REFERENCE TO RELATED APPLICATIONS

Pursuant to 35 USC Section 19(e), this application claims the benefit of data and right of priority to U.S. Provisional Patent Application No. 60/388,548 filed on Jun. 12, 2002, the content of which is hereby incorporated by reference herein in its entirety.

BACKGROUND

1. Field of the Invention

The present invention relates to a display system, and more particularly, to a monolithic double-sided display that allows for swift and effortless display and replacement of one or more two-dimensional display items.

2. Related Art

Two-dimensional display items such as signs, pictures and other types of prints are often framed for display purposes. Framing a two-dimensional display item helps adding to it luster and rigidity. It also provides an overall more presentable and durable display environment.

The prior art frames and display apparatus that are currently used and ically, are made to fit a particular size of a display item, and are fairly manufacture as they are made of multiple pieces and segments of wood, ass that require assembly.

Typically, to mount or replace a two-dimensional display item, the different pieces and segments of the frame need to be moved or adjusted so that the display item can properly fit into the frame. For example, most frames require a the back portion of the display frame to be lifted or removed so that the display item can be secured in between the back portion and a display window. This can be time consuming, inconvenient and inefficient.

Further, most prior art frames do not allow for the double-sided display of one or more display items and fail to provide a mechanism that allows for quick engagement and disengagement of a display item. The above disadvantages are particularly cumbersome if various sizes of display items are to be mounted in the same frame.

For example, one commonly used display apparatus for displaying commercial signs, such as "for sale" signs, is a plastic frame that includes a side opening in form of an elongated slot that allows for the insertion of a sign into the body of the frame. Grooves at the inner perimeters of the frame can slidably engage the sides of the sign so long as the dimensions of the sign approximately match those of the frame.

Unfortunately, however, due to the limitations associated with the depth and width of the grooves and also the dimensions of the prior art frame, only a small number of signs can appropriately fit in or match the prior art frame. That is, signs that are not of the appropriate dimension or thickness cannot be properly mounted or tightly secured in the prior art frame. An improved display apparatus is needed that can overcome the aforementioned shortcomings.

SUMMARY OF THE INVENTION

The present invention relates to a monolithic double-sided display that allows for swift and effortless display and replacement of one or more two-dimensional display items.

In accordance with one aspect of the invention, a display apparatus for securing a display item comprises: a monolithic frame made of a flexible light weight material having a body with a central opening within which one or more display items can be mounted. The display apparatus further comprises: one or more fastening mechanisms extended from the inner perimeters of the frame body inward toward the central opening for slidably receiving the one or more display items.

In one or more embodiments, the fastening mechanisms comprise: first and second flexible loop tongues each having inner and outer surfaces; the inner surfaces of the first and second loop tongues facing each other and coplanar to provide a receiving space therebetween, such that one or more edges of at least one display item can be frictionally secured in between said inner surfaces by extending the coplanar inner surfaces of the flexible loop tongues apart to tightly fit therein.

In one or more embodiments, the fastening mechanisms further comprise: one or more flange-like protrusions formed on the inner surface of the first flexible loop tongue opposite matching indentations formed on the inner surface of the second flexible loop tongue for receiving the respective flange-like protrusions. When the one or more edges of at least one display item are inserted in the receiving space between the inner surfaces of said flexible loop tongues, the pressure applied as the result of the deflection of the extended coplanar inner surfaces toward each other causes said edges to be securely mounted and received in between said inner surfaces of the first and second flexible loop tongues.

The features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood, however, that both the above summary and the following detailed description are exemplary and explanatory and are intended to provide further explanation of the invention as claimed and as such shall not be construed to limit the scope of the invention in any manner.

BRIEF DESCRIPTION OF THE DRAWINGS

The accompanying drawings, which are included to provide a further understanding of the invention, are incorporated in and constitute a part of this specification.

Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENT

Figure 1:
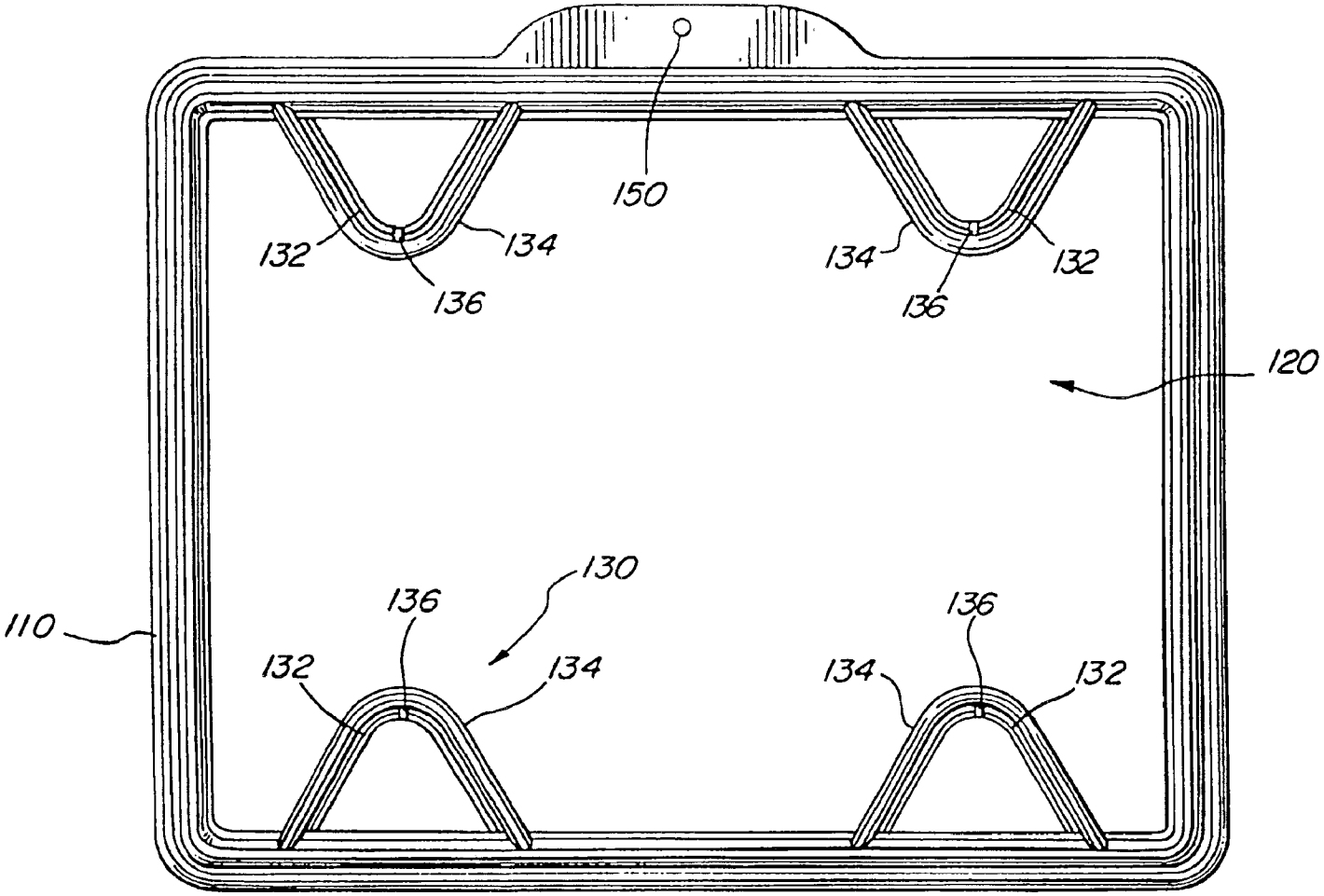
FIG. 1 illustrates a front external view of the display apparatus of the present invention, in accordance with one embodiment.
Figure 2:
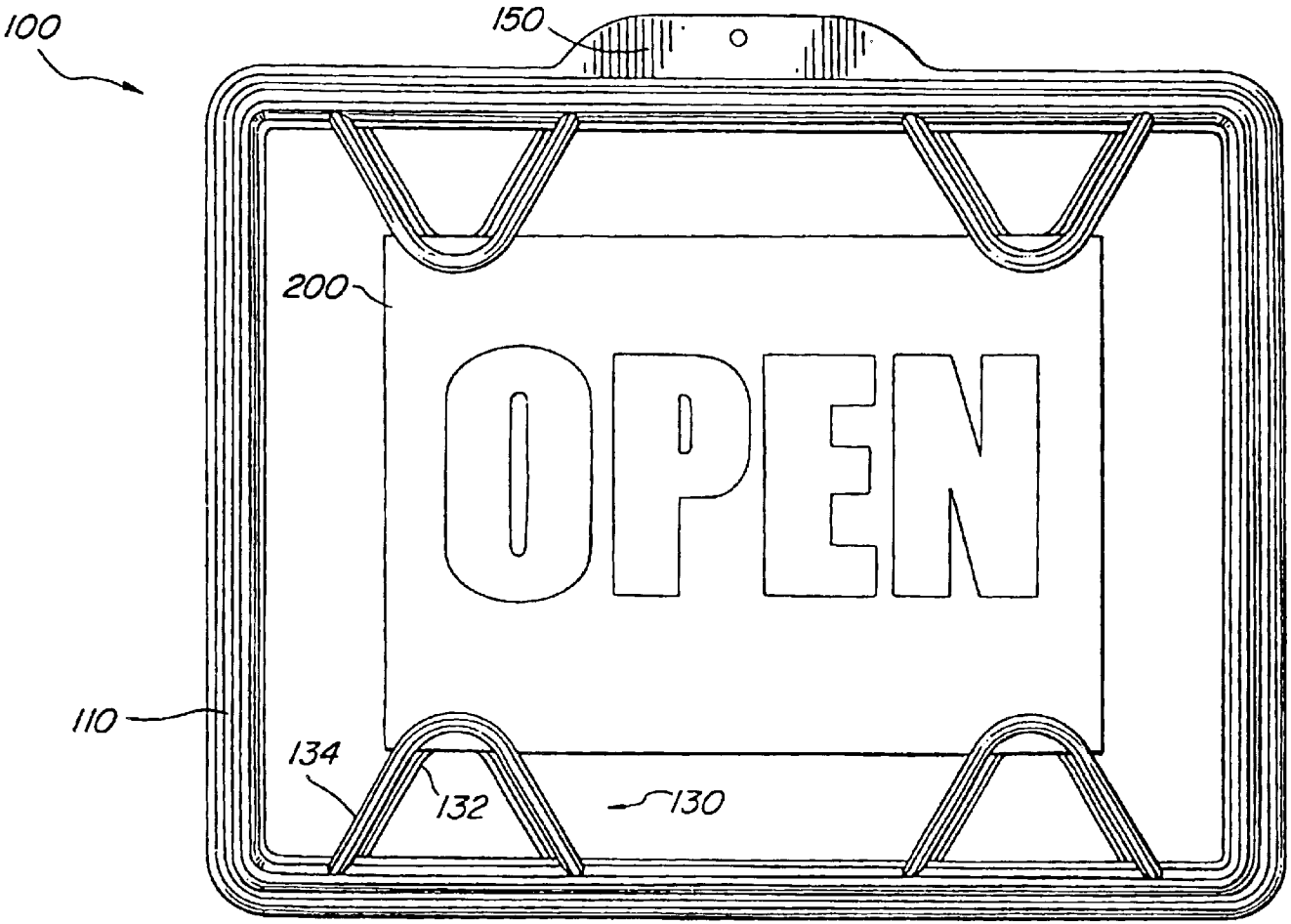
FIG. 2 illustrates a front external view of the display apparatus of FIG. 1 with a display item secured therein, in accordance to one embodiment of the invention.
Figure 3:
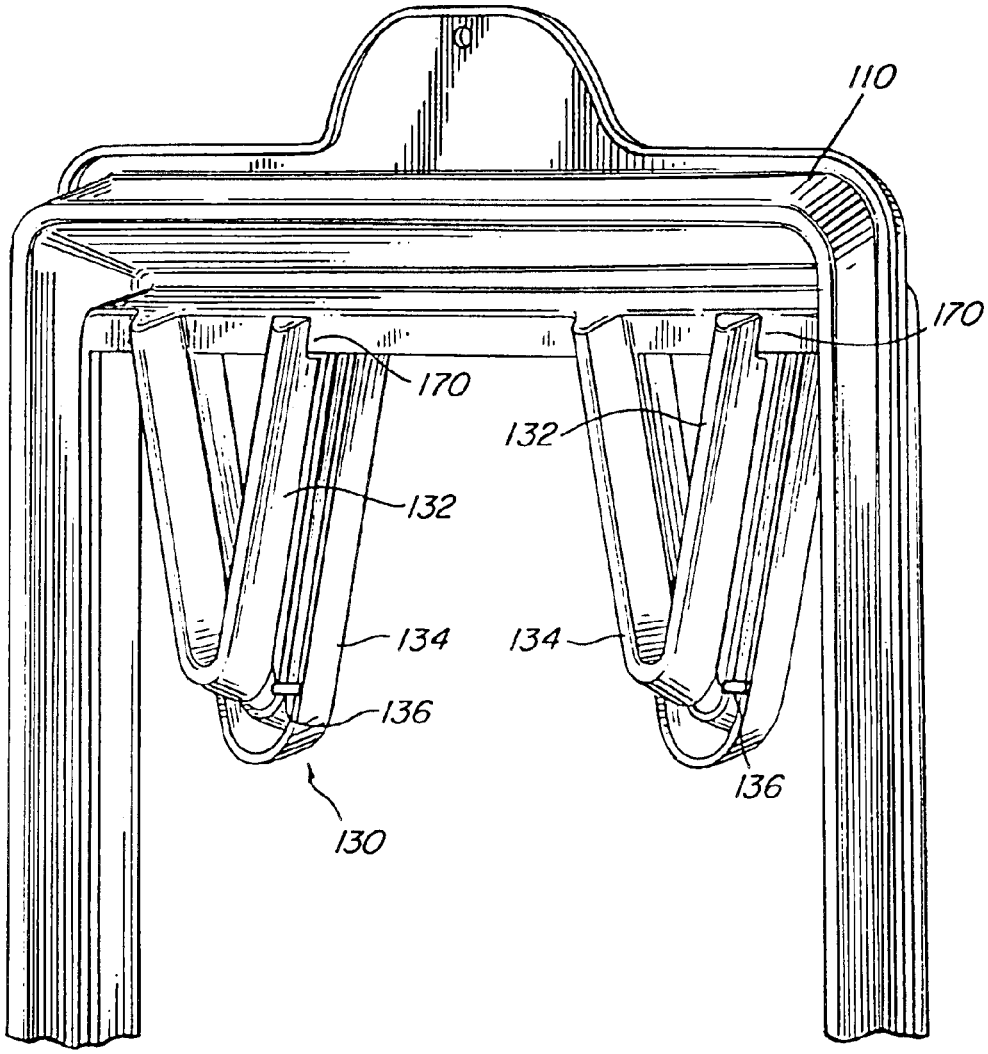
FIG. 3 illustrates a perspective external view of the display apparatus of the present invention, in accordance with one embodiment.

In the following, certain embodiments, aspects, advantages, and novel features of the invention have been provided. It is to be understood that not all such advantages may be achieved in accordance with any one particular embodiment. Thus, the invention may be embodied or carried out in a manner that achieves or optimizes one advantage or group of advantages as taught herein without necessarily achieving other advantages as may be taught or suggested herein. Reference will now be made in detail to the preferred embodiments of the present invention, examples of which are illustrated in the accompanying drawings.

Referring to FIGS. 1 through 5, in accordance with one aspect of the invention, a display apparatus 100 for securing a display item 200 comprises a monolithic frame made of a flexible lightweight material, such as for example plastic. The frame has a body 110 with a central opening 120 within which one or more display items 200 can be mounted. In one or more embodiments, the frame body 110 is formed substantially in shape of a rectangle having, preferably, a rectangular central opening 120.

In other embodiments, frame body 110 or central opening 120 may be substantially circular, triangular, or formed in any other geometric shape. The circular opening 120 is provided such that when a display item 200 is placed in the frame body 110, both front and back portion of the display item 200 are viewable.

The display apparatus 100 further comprises one or more fastening mechanisms 130 extended from the inner perimeters of the frame body 110 inward toward the center of the display apparatus 100 for slidably receiving the one or more display items. In one or more embodiments, each fastening mechanisms 130 comprise: first and second flexible loop tongues 132 and 134. Each flexible loop tongue 132 and 134 has inner and outer surfaces. The inner surface of the first loop tongue 132 faces the inner surface of the second loop tongue 134. Said inner surfaces are coplanar to provide a tight receiving space where the edges of one or more display items 200 can be inserted.

That is, the receiving space in between the first and second loop tongues 132 and 134 is configured such that one or more edges of at least one display item 200 can be frictionally secured in between said inner surfaces. When the edges of one or more display items 200 are inserted between the receiving space, said one or more edges spread apart the coplanar surfaces of the flexible loop tongues 132 and 134 away from one another. Due to the flexible nature of the material from which the flexible loop tongues 132 and 134 are made, the receiving space can be adjusted in response to applied pressure to fit more than one display item 200.

Figure 4:
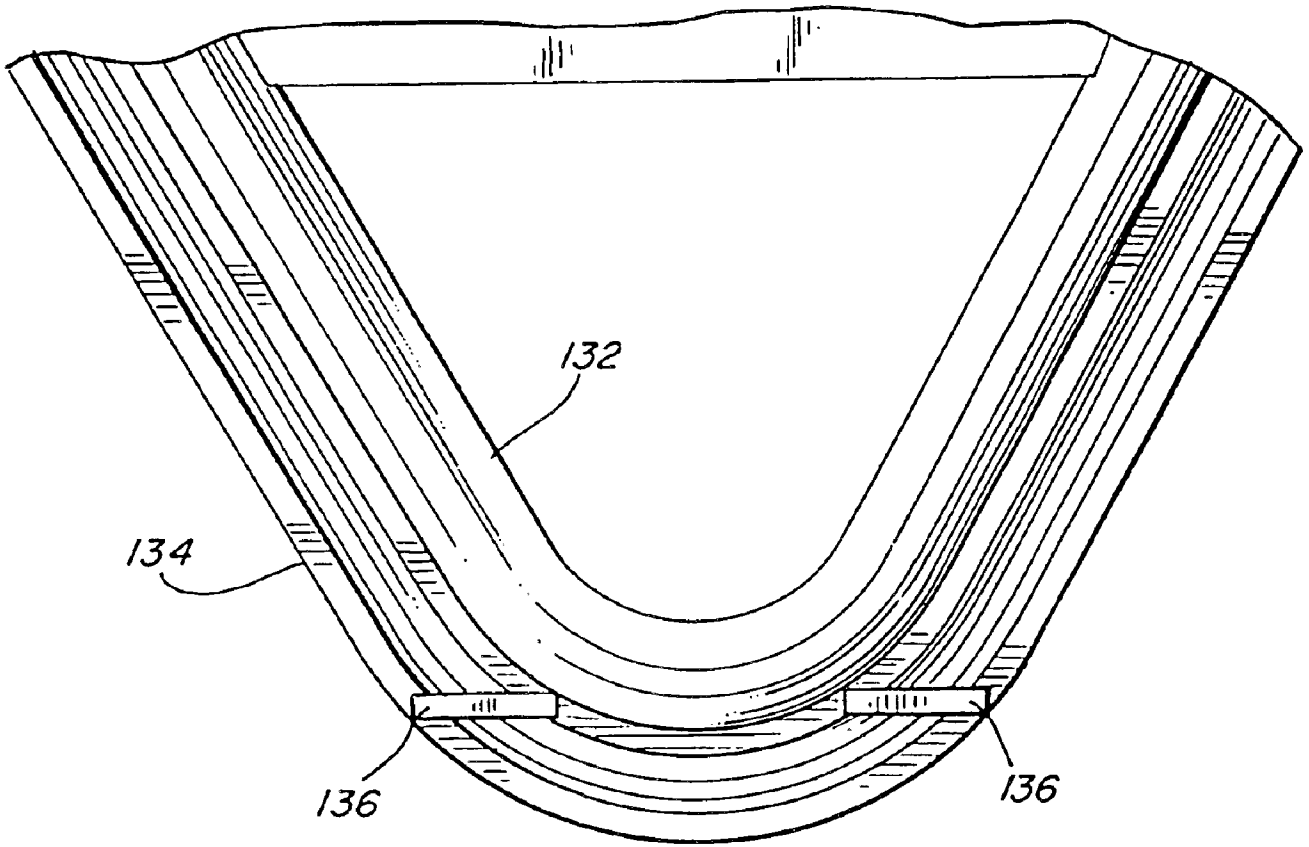
FIGS. 4 through 5 illustrate various views of the fastening system of the present invention, in accordance with one or more embodiments.
Figure 5:
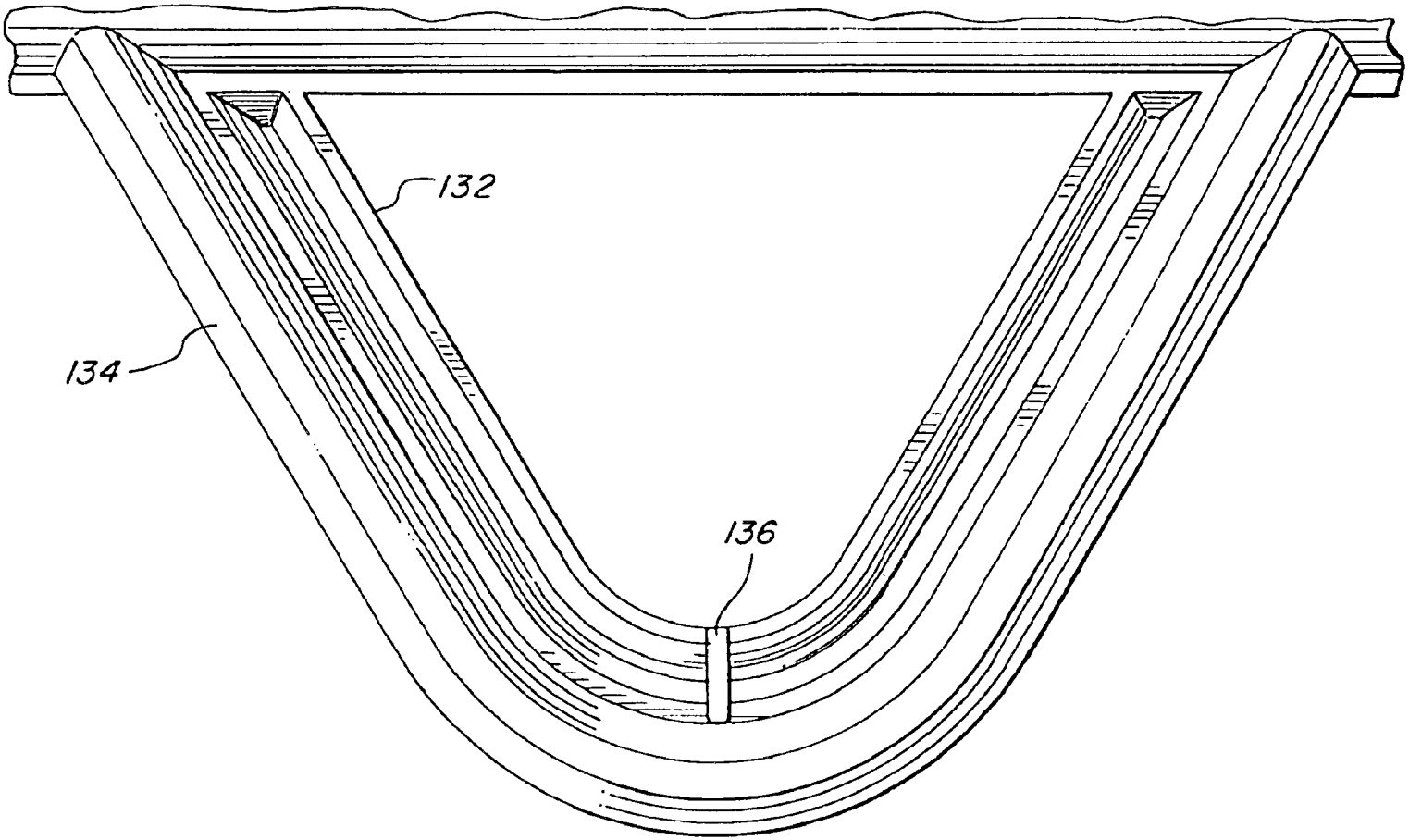

In one or more embodiments, the fastening mechanisms 130 further comprise one or more flange-like protrusions 136 formed on the inner surface of a first flexible loop tongue 132 opposite one or more matching indentations (not shown) formed on the inner surface of a second flexible loop tongue 134. The matching indentations on the inner surface of the second flexible loop tongue 134 are configured to receive the respective flange-like protrusions 136 formed on the first flexible loop tongue 132. As shown in FIGS. 4 and 5, the flange-like protrusions 136 can be designed to extend either vertically or horizontally with respect to the upper lateral segment of the frame body 110.

In a preferred embodiment, for example, the vertical design (i.e., as shown in FIG. 5) is utilized so that when the edge of a display item 200 is inserted in the receiving space, the edge can smoothly glide between the first and second flexible loop tongues 132 and 134. In some embodiments, instead of the opposite matching indentations, the inner surface of the second flexible loop tongue 132 is designed to also include flange-like protrusions 136 (not shown). In a preferred embodiment, for example, the flange-like protrusions on the inner surfaces of the flexible loop tongues 132 and 134 are spaced apart such that they do not rest opposite each other.

For example, referring to FIG. 5, in certain embodiments, the inner surface of first flexible loop tongue 132 includes a single flange-like protrusion 136 formed approximately at the center of the pointed edge of the first flexible loop tongue 132; and the inner surface of second flexible loop tongue 134 includes two flange-like protrusions formed equidistance from the center of the pointed edge of the second flexible loop tongue 134, such that single flange-like protrusion 136 rests in between them. In embodiments of the invention, the inner surfaces of the first and second flexible loop tongues 132 and 134 may have a concave design. In such an embodiment, the flange-like protrusions 136 may be formed in shape of bridges with a hollow underside.

When the one or more edges of at least one display item 200 are inserted in the receiving space between the inner surfaces of said flexible loop tongues 132 and 134, the pressure applied as the result of the deflection of the extended coplanar inner surfaces toward each other causes said edges to be securely mounted and received in between said inner surfaces of the first and second flexible loop tongues 132 and 134.

The display apparatus 100, in one embodiment, comprises at least 4 fastening mechanisms 130, positioned approximately diametrically opposed one another and evenly spaced within the inner parameter of frame body 110, as shown in FIG. 1. Other embodiments may comprise of more or less fastening mechanisms depending on the shape of the frame body 110. Flexible loop tongues 132 and 134 may be in the shape of half circles, triangles, ellipses, or other geometric shapes with a central opening through which the surface of a display item 200 may be visually displayed.

The size and shape of the flexible loop tongues 132 and 134 are designed such that the inner most edges of the flexible loop tongues 132 and 134 and their counterparts approximately extend toward the center of the display apparatus 100. In some embodiments, said inner most edges may extend so far inward to reach an opposite lateral segment of the frame body 110. In a preferred embodiment of the invention, said inner most edges extend approximately half way toward the center of the frame body 110. This extension provides for the possibility of mounting a display item 200 within the display apparatus 100, where the outer perimeters of the display item 200 are smaller than the inner perimeters of the frame body 110.

In certain embodiments of the invention, a second opening 150, preferably smaller in diameter than the central opening 120 is provided on an upper lateral segment of frame body 110 to allow for the suspension of display apparatus 100 from a point of suspension in a horizontal position, for example. A point of suspension may be provided, for example, by way of a nail, screw, hook, or other equivalent mechanisms that can be inserted, attached, or otherwise fastened to a supporting structure. In some embodiments of the invention, fastening mechanisms such as Velcro™, surface applicable adhesive material, suction cup, or functional equivalents thereof may be utilized to fasten the point of suspension to a supporting structure.

In a preferred embodiment, the frame body 110 comprises a centered, predrilled, outward tab extension as shown in FIG. 1 that includes the opening 150. In some embodiments, a third opening (not shown) may be provided on one or both lateral side segments of the frame body 110 to allow for the suspension of display apparatus 100 from a point of suspension in a vertical position, for example.

In one or more embodiments, the flexible loop tongues 132 and 134 are extensions of the upper and lower lateral segments of the frame body 110. As shown in FIG. 4, in one embodiment, at least one groove 170 is formed between the lateral segment of the frame body 110 and a first flexible loop tongue 132, for example, to enhance the flexibility of the first flexible loop tongue 132.

As shown, groove 170 diagonally cuts into the lateral segment of the frame body 110 where the first flexible loop tongue 132 extends out of the frame body 110. Groove 170 allows a part of the lateral segment to flex in addition to the flexible loop tongue 132, thereby reducing the amount of applied pressure to the structure of the flexible loop tongue 132 at the portion where the flexible loop tongue 132 extends from the lateral segment of the frame body 110. This distribution of pressure between the flexible loop tongue 132 and the frame body 110 makes the frame less susceptible to breakage and fracture at the point of attachment of the fastening mechanisms 130 to the frame body 110.

The frame body 110 may be made of any color. Some embodiments may be accompanied by artwork preinstalled within the frame, or a CD ROM diskette, or other computer readable recording medium including a collection of various signs or artwork that can be printed by the purchaser on a printer separately. A particular embodiment of the invention would also provide access to a website from which artwork could be printed or designed for display in the display apparatus 100.

As such the present invention provides a monolithic double-sided display apparatus 100 that allows for quick and easy mounting of a display item 200 without the need to assemble or disassemble various segments of the display apparatus 100. Due to the length of the inward projection of the fastening mechanisms 130, the display apparatus 100 can support display items 200 in a variety of sizes and geometries.

Although particular embodiments of the invention have been shown and described, it will be apparent to those skilled in the art that changes and modifications may be made without departing from the invention in its broader aspects, and therefore, the appended claims are to encompass within their scope all such changes and modifications that fall within the true scope of the invention.

What is claimed is:

1. A display apparatus for securing a display item for display, the display apparatus comprising:

a one-piece frame made of a flexible light weight material having a body formed around the periphery of a central opening within which one or more display items of various sizes can be mounted, the one-piece frame comprising:

one or more fastening mechanisms extending from the inner perimeters of the frame body inward toward center of the central opening for slidably receiving the one or more display items, each of the fastening mechanisms comprising:

first and second flexible loop tongues each having inner and outer surfaces, the inner surfaces of the first and second loop tongues being approximately flat and facing each other and said inner surface being approximately coplanar to provide a receiving space therebetween, such that one or more edges of at least one display item can be frictionally secured in between said receiving space by wedging open the coplanar inner surfaces of the flexible loop tongues apart for a frictionally tight fit therebetween.

2. The display apparatus of claim 1, wherein the fastening mechanisms further comprises at least one flange-like protrusion formed on the inner surface of the first flexible loop tongue.

3. The display apparatus of claim 2, wherein the fastening mechanisms further comprises at least one matching flange-like protrusion formed on the inner surface of the second flexible loop tongue approximately opposite to said flange-like protrusion.

4. The display apparatus of claim 3, wherein the flange-like protrusion and the matching indentation formed approximately opposite thereto are configured to receive one or more edges of at least one display item inserted in the receiving space between the inner surfaces of said first and second flexible loop tongues.

5. The display apparatus of claim 4, wherein the receiving space between the inner surfaces of said first and second flexible loop tongues is configured to apply a pressure to provide for secure mounting of a display item between said first and second flexible loop tongues.

6. The display apparatus of claim 3, wherein the flange-like protrusion is shaped as an elongated bar, wherein the bar extends approximately towards the center of the central opening.

7. The display apparatus of claim 3, wherein the flange-like protrusion is shaped as an elongated bar, wherein the bar extends approximately toward lateral sides of the body of the frame.

8. The display apparatus of claim 1, wherein the body is rectangular in shape.

9. The display apparatus of claim 1, wherein the one or more fastening mechanisms are approximately in the shape of a triangle.

10. The display apparatus of claim 1 further comprising means for hanging the display apparatus from a point of suspension.

11. A display apparatus, having a one-piece construction, for securing a display item for display, such that the display item is displayable from front and back portions of the display apparatus, the display apparatus comprising:

a monolithic frame made of a flexible plastic polymer having a body formed around the periphery of a central opening within which one or more display items of varying sizes can be mounted; and one or more fastening mechanisms extending from the inner perimeters of the frame body inward toward center of the central opening for slidably receiving the one or more display items, wherein each of the fastening mechanisms is an integral part of the frame, and each of the fastening mechanisms comprises:

first and second flexible loop-shaped tongues each having inner and outer surfaces, the inner surfaces of the first and second loop-shaped tongues being flat and approximately coplanar to provide a receiving space therebetween, such that one or more edges of at least one display item can be frictionally secured in between said receiving space by wedging open the coplanar inner surfaces of the flexible loop tongues apart for a frictional fit therebetween, such that said display item is viewable through the first and second loop tongues.

* * * * *